United States Patent [19]

Hambleton

[11] 4,437,634

[45] Mar. 20, 1984

[54] PLASTIC SACK HOLDER

[75] Inventor: Thomas P. Hambleton, Pine Bush, N.Y.

[73] Assignee: International Paper Company, New York, N.Y.

[21] Appl. No.: 296,945

[22] Filed: Aug. 28, 1981

[51] Int. Cl.[3] ..... A63B 55/04

[52] U.S. Cl. ..... 248/97; 248/99

[58] Field of Search ..... 248/95, 98, 99, 100, 248/101; 53/390

[56] References Cited

U.S. PATENT DOCUMENTS

| | | | |
|---|---|---|---|
| 63,383 | 4/1867 | Hanks . | |
| 1,005,956 | 10/1911 | Gibbons . | |
| 1,057,240 | 3/1913 | Hildreth . | |
| 1,078,083 | 11/1913 | Blood | 246/99 |
| 1,103,370 | 7/1914 | Moore . | |
| 1,265,996 | 5/1918 | Cerny | 248/99 |
| 1,307,439 | 6/1919 | Farnsworth et al. | 248/99 |
| 1,431,726 | 10/1922 | Cupples . | |
| 1,455,536 | 5/1923 | Lebherz . | |
| 1,502,597 | 7/1924 | Taylor | 248/97 |
| 1,679,450 | 8/1928 | Thompson . | |
| 1,699,188 | 1/1929 | Granberg . | |
| 1,700,248 | 1/1929 | Wolfe . | |
| 2,062,023 | 11/1936 | Gosselin | 248/99 |
| 2,754,076 | 7/1956 | Westervelt | 248/100 X |
| 3,140,070 | 7/1964 | Doebele | 248/97 |
| 3,142,465 | 7/1964 | Hellner | 248/99 |
| 3,161,391 | 12/1964 | Bahnsen | 248/99 |
| 3,313,504 | 4/1967 | Stoltze | 248/99 |
| 3,374,976 | 3/1968 | Kurlander | 248/97 |
| 3,388,882 | 6/1968 | Burroughs et al. | 248/97 |
| 3,468,100 | 9/1969 | Rubel | 53/189 |
| 3,512,338 | 5/1970 | Nestler | 53/390 |
| 3,605,383 | 9/1971 | Piazze | 53/385 |
| 3,627,242 | 12/1971 | Vandermast | 248/97 |
| 3,678,652 | 7/1972 | Panasewicz | 53/385 |
| 3,687,408 | 8/1972 | Lake | 248/97 |
| 3,707,826 | 1/1973 | Cole | 53/384 |
| 3,715,854 | 2/1973 | Smith et al. | 53/29 |
| 3,727,374 | 4/1973 | Williams | 53/189 |
| 3,737,129 | 6/1973 | Foster | 248/97 |
| 3,747,298 | 7/1973 | Lieberman | 53/390 |
| 3,756,548 | 9/1973 | Santarelli et al. | 248/98 |
| 3,826,455 | 7/1974 | O'Donnell | 248/97 |
| 3,840,092 | 10/1974 | Close | 186/1 AC |
| 3,869,065 | 3/1975 | Wang | 221/40 |
| 3,902,570 | 9/1975 | Close | 186/1 AC |
| 4,020,618 | 5/1973 | Benzon-Peterson et al. | 53/390 |
| 4,062,170 | 12/1977 | Orem | 53/390 |
| 4,157,801 | 6/1979 | Elmer | 248/97 |
| 4,316,591 | 2/1982 | Muraoka | 248/97 |

FOREIGN PATENT DOCUMENTS

| | | | |
|---|---|---|---|
| 2002732 | 8/1970 | Fed. Rep. of Germany | 248/100 |
| 1936742 | 2/1971 | Fed. Rep. of Germany . | |
| 120020 | 10/1970 | Norway | 248/100 |
| 598057 | 11/1977 | Switzerland . | |
| 2060547 | 5/1981 | United Kingdom | 53/390 |

*Primary Examiner*—J. Franklin Foss

*Attorney, Agent, or Firm*—Richard J. Ancel

[57] ABSTRACT

The present invention is directed to a device to hold open for loading a limp plastic sack having a pair of integral handles and a body portion terminating in a base portion. It comprises a horizontally disposed base member; a pair of oppositely-disposed, upwardly-projecting side wall members, which are attached at their lower ends to the base member; an upwardly projecting rear wall member, wherein each vertical edge of the rear wall member is attached to a vertical edge of each of the side wall members; and means to engage the handles of the plastic sack, said means comprising a pair of spaced apart protuberances that are affixed to the outer side, and near the upper edge, of each of the side wall members. Preferably, the height of each side wall member is slightly smaller than the height of the plastic sack to be loaded therein, and the internal perimeter of the base member is at least equal to or slightly greater than the perimeter of the base of the plastic sack when the sack is in an open position ready for loading.

22 Claims, 3 Drawing Figures

FIG. 1
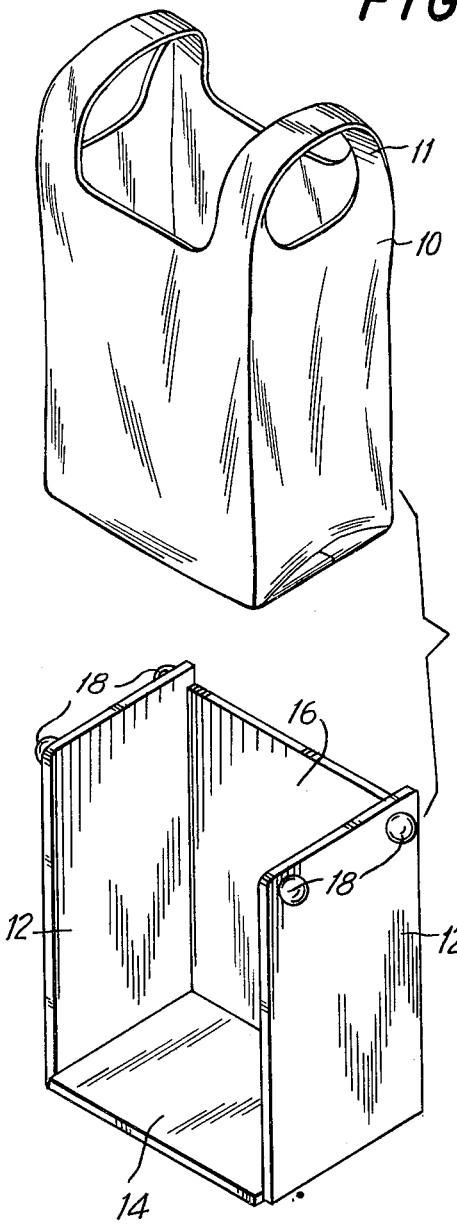
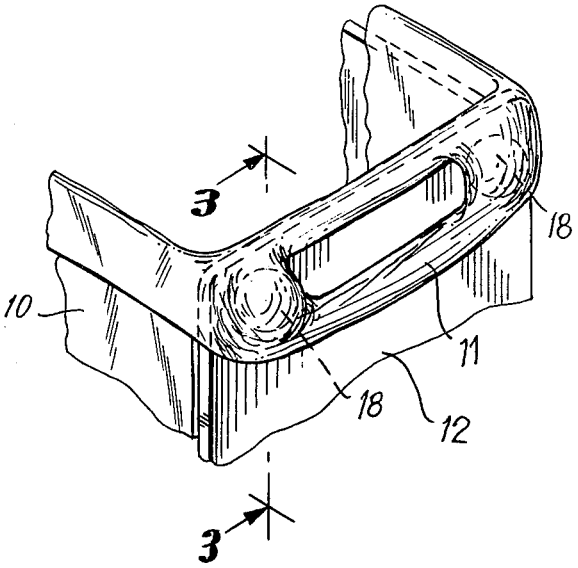
FIG. 2
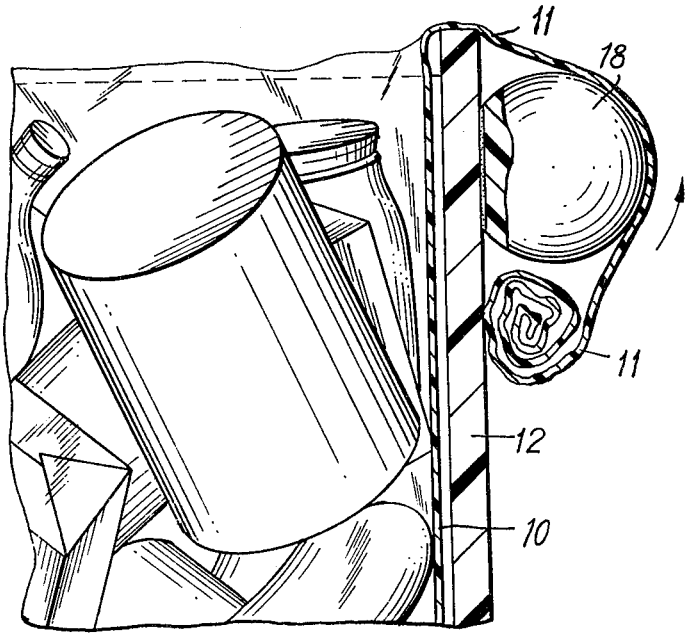
FIG. 3

PLASTIC SACK HOLDER

BACKGROUND OF THE INVENTION

This invention relates to a device to hold open for loading a limp plastic sack having a pair of integral handles.

In an effort to reduce overhead costs, many retail establishments, such as supermarkets, are using, or are considering using, semi-automated systems at the checkout counter. Such systems can eliminate the need for both a cashier and a packer because they permit the cashier not only to charge each article, but to package same immediately thereafter in an opened grocery bag. Such systems involve the use of electronic scanning devices that "read" coded labels printed on each item. Generally, such semi-automated systems work as follows: the cashier picks up the article to be charged, registers its price by passing its coded label by a scanning device, and places it in a grocery sack.

One method of packaging such items involves the use of thin, plastic sacks. In certain markets, such sacks are becoming more popular than traditional paper grocery sacks because they eliminate the need for double bagging, and they are more moisture resistant than paper sacks. However, these sacks are fabricated from thin, plastic materials and, unlike paper sacks, are incapable of supporting themselves when opened. Hence, devices which will hold such plastic sacks open for loading are needed if the cashier is also to serve as a packer.

One sack holder is illustrated in U.S. Pat. No. 4,062,170, which shows a holder having upwardly projecting elongated tabs at the upper end of a pair of side walls, each of said tabs having rearward projections. According to the disclosure therein, a plastic sack having a pair of handles is opened, and the handle openings are then placed over the rearwardly projecting portions of the elongated tabs. It has been found, however, that this device has certain drawbacks because the groceries, when fully loaded, cause downward pressure to be exerted on the walls of the sack, which, in turn, exerts downward pressure on the sack handles. Hence, when the cashier attempts to remove the handles from the upward and rearward projections, it may be necessary for him or her to lift the fully loaded sack of groceries to disengage it from the device.

SUMMARY OF THE INVENTION

The present invention provides a device to hold open for loading a limp plastic sack having a pair of integral handles and a body portion terminating in a base, which device permits the easy disengagement of the handles from the device, even when the plastic sack is fully loaded. The device comprises a base member, a pair of side wall members, a rear wall member, and a pair of spaced apart protuberances affixed to the outer side, and near the upper edges, of each of the side wall members. Preferably, the height of each side wall member is slightly less than the height of the body portion of the plastic sack to be loaded therein, and the internal perimeter of the base member is at least equal to or slightly greater than the perimeter of the base of the plastic sack when the sack is open and ready to be loaded.

The full nature of the invention will be understood from the accompanying drawings and the following description and claims. It should be understood, however, that references in the following description to base, rear, and side wall members are for convenience of description, and such terms are not intended to be used in a limiting sense.

BRIEF DESCRIPTION OF THE DRAWINGS

FIG. 1 is a perspective view of the device and a sack about to be loaded therein.

FIG. 2 is a view of the plastic sack in the device and illustrates the interaction between the handles of the sack and the handle engaging means of the device.

FIG. 3 is a cross-sectional view taken along line 3—3 of FIG. 2.

DETAILED DESCRIPTION OF THE INVENTION

The preferred embodiment of the device of the present invention is best depicted in FIG. 1 of the drawings. As illustrated therein, it comprises a horizontally disposed base member or bottom wall 14; a pair of oppositely disposed, upwardly projecting side wall members 12, which are attached at their lower ends to base member 14; an upwardly projecting rear wall member 16, wherein each vertical edge of rear wall member 16 is attached to a vertical edge of each of the side wall members 12; and means 18 to engage the handles of a limp plastic sack, said means comprising a pair of spaced apart protuberances 18 attached to the outer side of, and near the upper edges of, each of the side wall member 12. As is also illustrated in FIG. 1, the height of the side wall members 12 is slightly greater than the height of rear wall member 16; although the side and rear wall members may be the same height.

A plastic sack that is suitable for use with the device of this invention is also illustrated in FIG. 1. It consists of a pair of integral handles 11 and a body portion 10 terminating in a base portion. In the trade, it is known as a "T-shirt sack," in view of its configuration. Preferably, the sack is formed for a gusseted, flattened tube of thermoplastic material, such as polyethylene. Thus, the handles 11 are also gusseted, and this provides a double thickness handle for strength. Although such sacks are manufactured in a variety of sizes, the size of a typical grocery sack is designated as one-sixth of a barrel.

A holding device of this invention may be constructed as follows: the internal perimeter of its base (its width and depth) should be at least equal to or, preferably, slightly larger than the perimeter of the base of the sack to be used therewith, in order to allow the sack to be fully loaded with goods and to support it while it is being filled. On the other hand, the height of the side wall members should be, preferably, slightly smaller than the height of the body portion of the sack. Thus, as shown in FIG. 2, when the sack is placed in the holding device, the upper portion of its body is folded over the upper portion of the holding device and the gusseted portion of the handles are folded over the spaced apart protuberances 18.

In this connection, the dimensions of a device suitable for "T-shirt" sacks of the one-sixth barrel size are the following: the height of the rear wall (16) is 15¼"; the width of the rear wall (16) is 11½"; the width of each side wall member (12) is 7½"; and the height of each side wall member (12) is 16". Since the spaced apart protuberances 18 are designed to hold the integral sack handles 11 down while the sack is being filled with groceries or other goods, and since they are also designed to allow the easy removal of the filled grocery sack from the device, it has been found that if they are knob-like in shape and if each knob-like protuberance (which is about 1¼" in diameter) is located at a point 1" below the upper edge of the side wall 12, and 1" in from the vertical edge of side wall 12, these goals can be attained.

The folding of the handles 11 over the knob-like protuberances 18 is best illustrated in FIGS. 2 and 3.

Although protuberances 18 have been described as "knob-like," it should be understood that the term "knob-like" refers not only to generally spherical protuberances as illustrated in FIGS. 1–3 herein, but to protuberances that may be sculpted into various other shapes, which shapes are characterized by having curved surface areas which facilitate the locking of the handles thereon but which also prevent problems or snags when the cashier attempts to disengage the sack handles from the protuberances. In addition, the knob-like protuberances on each side wall member may be of different sizes or configurations, depending on the "T-shirt" sack to be used with the device.

The device of this invention can be used as follows: a cashier at the checkout counter takes a sack from a stack of same, opens it and places each handle over the knob-like protuberances 18, affixed to each side wall 12. The cashier can then proceed to charge each item by ringing it up on the cash register, or by passing its coded label (with the Universal Product Code printed thereon) over an electronic scanning device, to thereby charge same and by then placing the charged item in the opened sack. When the sack is filled, the cashier removes the handles from knob-like protuberances 18, without the necessity of lifting the filled package off bottom wall 14 until such time that the handles are clear of knob-like protuberances 18, and the filled sack can then be handed to the purchaser.

As is obvious, the device of this invention may be manufactured in any size to fit a particular size "T-shirt sack." In addition, it may be constructed of any substantially rigid material, such as plastic, metal, or wood. It has been found, though, that rigid plastic sheets, such as acrylic Plexiglass are suitable.

Generally speaking, the present invention is directed to a device to hold open for loading a limp plastic sack having a pair of integral handles and a body portion terminating in a base portion. It comprises a horizontally disposed base member; a pair of oppositely disposed, upwardly projecting, side wall members, which are attached at their lower ends to the base member; an upwardly projecting rear wall member, wherein each vertical edge of the rear wall member is attached to a vertical edge of each of the side wall members; and means to engage the handles of the plastic sack, said means comprising a pair of spaced apart, knob-like protuberances that are affixed to the outer side, and near the upper edge, of each of the side wall members. Preferably, the height of each side wall member is slightly less than the height of the plastic sack to be loaded therein, and the internal perimeter of the base wall member is at least equal to or slightly greater than the perimeter of the plastic sack when the sack is in an open position ready for loading.

Although the invention has been described above by reference to a preferred embodiment, it will be appreciated that other constructions may be devised, which are, nevertheless, within the scope and spirit of the invention and are defined by the claims appended hereto.

What is claimed is:

1. A device to hold open for loading a limp plastic sack having a pair of integral handles and a body portion terminating in a base portion, said device comprising:

(a) a base member;

(b) a pair of side wall members attached at their lower ends to said base member;

(c) a rear wall member attached to each of said side wall members;

(d) means to engage the handles of said plastic sack, said means comprising a pair of spaced apart knob-like protuberances attached to the outer side and near the upper edge of each of said side wall members; wherein the height of said side wall members is slightly less than the height of the plastic sack to be loaded therein and wherein the internal perimeter of said base member is at least equal to the perimeter of the base of said plastic sack when said sack is in an open position and ready for loading.

2. A device as claimed in claim 1, wherein the internal perimeter of said base member is slightly greater than the perimeter of the base of said plastic sack when said sack is in an open position and ready for loading.

3. A device as claimed in claim 2, which is fabricated from a rigid material.

4. A device as claimed in claim 3, wherein said rigid material is a plastic material.

5. A device to hold open for loading a limp plastic sack having a pair of integral handles and a body portion terminating in a base portion, said device comprising:

(a) a horizontally-disposed base member;

(b) a pair of oppositely-disposed, upwardly-projecting side wall members attached at their lower ends to said base member;

(c) an upwardly-projecting rear wall member, wherein each vertical edge of said rear wall member is attached to a vertical edge of each of said side wall members;

(d) means to engage the handles of said plastic sack, said means comprising a pair of spaced apart, knob-like protuberances attached to the outer side and near the upper edge of each of said side wall members;

wherein the height of said side wall members is slightly less than the height of the plastic sack to be loaded therein and wherein the internal perimeter of said base member is at least equal to the perimeter of the base of said plastic sack when said sack is in an open position and ready for loading.

6. A device as claimed in claim 5, wherein the internal perimeter of said base member is slightly greater than the perimeter of the base of said plastic sack when said sack is in an open position and ready for loading.

7. A device as claimed in claim 6, which is fabricated from a rigid material.

8. A device as claimed in claim 7, wherein said rigid material is a plastic material.

9. A device to hold open for loading a limp plastic sack having a pair of integral gusseted handles and a body portion terminating in a base portion, said device comprising:

(a) a base member;

(b) a pair of side wall members attached at their lower ends to said base member;

(c) a rear wall member attached to each of said side wall members;

(d) means to engage the gusseted portions of the handles of said plastic sack, said means comprising a pair of spaced apart knob-like protuberances attached to the outer side and near the upper edge of each of said side wall members;

wherein the height of said side wall members is slightly less than the height of the plastic sack to be loaded therein and wherein the internal perimeter of said base member is at least equal to the perimeter of the base of said plastic sack when said sack is in an open position and ready for loading.

10. A device as claimed in claim 9, wherein the internal perimeter of said base member is slightly greater than the perimeter of the base of said plastic sack when said sack is in an open position and ready for loading.

11. A device as claimed in claim 10, which is fabricated from a rigid material.

12. A device as claimed in claim 11, wherein said rigid material is a plastic material.

13. A device to hold open for loading a limp plastic sack having a pair of integral, gusseted handles and a body portion terminating in a base portion, said device comprising:

(a) a horizontally-disposed base member;

(b) a pair of oppositely-disposed, upwardly-projecting side wall members attached at their lower ends to said base member;

(c) an upwardly-projecting rear wall member, wherein each vertical edge of said rear wall member is attached to a vertical edge of each of said side wall members;

(d) means to engage the gusseted portions of the handles of said plastic sack, said means comprising a pair of spaced apart, knob-like protuberances attached to the outer side and near the upper edge of each of said side wall members;

wherein the height of said side wall members is slightly less than the height of the plastic sack to be loaded therein and wherein the internal perimeter of said base member is at least equal to the perimeter of the base of said plastic sack when said sack is in an open position and ready for loading.

14. A device as claimed in claim 13, wherein the internal perimeter of said base member is slightly greater than the perimeter of the base of said plastic sack when said sack is in an open position and ready for loading.

15. A device as claimed in claim 14, which is fabricated from a rigid material.

16. A device as claimed in claim 15, wherein said rigid material is a plastic material.

17. A device to hold open for loading a limp plastic sack having a pair of intergral handles and a body portion terminating in a base portion, said device comprising:

(a) a base member;

(b) a pair of side wall members attached at their lower ends to said base members;

(c) a rear wall member attached to each of said side wall members; and (d) means to engage the handles of said plastic sack, said means comprising a pair of spaced apart, knob-like protuberances attached to the outter side and near the upper edge of each of said side wall members wherein the height of said side wall members is slightly less than the height of the plastic sack to be loaded therein and wherein the internal perimeter of said base member is at least equal to the perimeter of the base of said plastic sack when said sack is in an open position and ready for loading.

18. A device as claimed in claim 17, which is fabricated from a rigid material.

19. A device as claimed in claim 18, wherein said rigid material is a plastic material.

20. A device to hold open for loading a limp plastic sack having a pair of gusseted integral handles and a body portion terminating in a base portion, said device comprising:

(a) a horizontally-disposed base member;

(b) a pair of oppositely-disposed, upwardly-projecting side wall members attached at their lower ends to said base member;

(c) an upwardly-projecting rear wall member, wherein each vertical edge of said rear wall member is attached to a vertical edge of each of said side wall members; and (d) means to engage the gusseted portions of the handles of said plastic sack, said means comprising a pair of spaced apart, knob-like protuberances attached to the outer side and near the upper edge of each of said side wall members.

21. A device as claimed in claim 20, which is fabricated from a rigid material wherein the height of said side wall members is slightly less than the height of plastic sack to be loaded therein and wherein the internal perimeter of said base member is at least equal to the perimeter of the base of said plastic sack when said sack is in an open position and ready for loading.

22. A device as claimed in claim 21, wherein said rigid material is a plastic material.

* * * * *